US006129994A

United States Patent [19]

Harada et al.

[11] Patent Number: 6,129,994

[45] **Date of Patent: *Oct. 10, 2000**

[54] MEMBER HAVING COMPOSITE COATING AND PROCESS FOR PRODUCING THE SAME

[75] Inventors: Yoshio Harada; Noriyuki Mifune; Hirofumi Hisano, all of Hyogo, Japan

[73] Assignee: Tocalo Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,911

[22] PCT Filed: Mar. 6, 1996

[86] PCT No.: PCT/JP96/00546

§ 371 Date: Sep. 3, 1997

§ 102(e) Date: Sep. 3, 1997

[87] PCT Pub. No.: WO96/27694

PCT Pub. Date: Sep. 12, 1996

[30] Foreign Application Priority Data

Mar. 8, 1995 [JP] Japan ..... 7-048639

[51] Int. Cl.[7] ..... B32B 15/04; B05D 1/38; B05D 3/02

[52] U.S. Cl. ..... 428/627; 428/630; 428/631; 428/698; 427/427; 427/419.6; 427/419.7; 427/450; 427/376.2

[58] Field of Search ..... 427/376.2, 419.2, 427/427, 431, 443.2, 419.4, 419.7, 419.6, 376.4, 376.5, 453, 454, 455, 456, 450, 446; 428/627, 630, 631, 472, 698, 701, 702

[56] References Cited

U.S. PATENT DOCUMENTS

| | | | |
|---|---|---|---|
| 3,619,240 | 11/1971 | Toussaint et al. | 117/40 |
| 3,927,223 | 12/1975 | Takabatake et al. | 427/34 |
| 3,974,249 | 8/1976 | Roy et al. | 264/65 |
| 3,978,316 | 8/1976 | Rose et al. | 219/543 |
| 4,232,094 | 11/1980 | Rhodes et al. | 428/614 |
| 4,289,574 | 9/1981 | Radigan et al. | 156/643 |
| 4,564,555 | 1/1986 | HOrnberger | 427/312.8 |
| 4,582,725 | 4/1986 | Nakashima | 427/193 |
| 4,851,267 | 7/1989 | Miyauchi et al. | 427/357 |
| 5,102,697 | 4/1992 | Grunke et al. | 427/229 |
| 5,252,360 | 10/1993 | Hüttl et al. | 427/255.2 |
| 5,270,075 | 12/1993 | Robyn et al. | 427/201 |
| 5,271,821 | 12/1993 | Ogasawara et al. | 204/429 |

FOREIGN PATENT DOCUMENTS

| | | | |
|---|---|---|---|
| 52-16517 | 2/1977 | Japan . | |
| 52-22934 | 6/1977 | Japan . | |
| 53-128538 | 11/1978 | Japan | C23C 1/14 |
| 54-46145 | 4/1979 | Japan | B05D 5/08 |
| 56-112456 | 9/1981 | Japan | C23C 7/00 |
| 56-39709 | 9/1981 | Japan . | |
| 58-11507 | 3/1983 | Japan . | |
| 58-37386 | 8/1983 | Japan . | |
| 59-153875 | 9/1984 | Japan | C23C 1/14 |
| 61-41758 | 2/1986 | Japan | C23C 4/18 |
| 61-117260 | 6/1986 | Japan | C23C 2/00 |
| 62-260096 | 11/1987 | Japan | C25D 13/02 |
| 64-79356 | 3/1989 | Japan | C23C 2/00 |
| 1-108334 | 4/1989 | Japan | C22C 10/07 |
| 1-225761 | 9/1989 | Japan | C23C 4/00 |
| 2-43352 | 2/1990 | Japan | C23C 4/06 |
| 2-97686 | 4/1990 | Japan | C23D 5/00 |
| 2-125833 | 5/1990 | Japan | C22C 19/07 |
| 2-180755 | 7/1990 | Japan | C04B 38/56 |
| 2-212366 | 8/1990 | Japan | C04B 35/58 |
| 2-236266 | 9/1990 | Japan | C23C 4/06 |
| 3-44455 | 2/1991 | Japan | C23C 4/00 |
| 3-94048 | 4/1991 | Japan | C23C 2/00 |
| 3-63565 | 6/1991 | Japan . | |
| 3-64565 | 6/1991 | Japan | C23C 2/00 |
| 3-54181 | 8/1991 | Japan | C23C 2/00 |
| 4-13857 | 1/1992 | Japan | C23C 4/06 |
| 4-88159 | 3/1992 | Japan | C23C 4/10 |
| 4-27290 | 5/1992 | Japan | C23C 4/18 |
| 4-165058 | 6/1992 | Japan | C23C 4/06 |
| 4-254571 | 9/1992 | Japan | C23C 4/18 |
| 4-346640 | 12/1992 | Japan | C23C 2/06 |
| 4-358055 | 12/1992 | Japan | C23C 4/10 |
| 5-33113 | 2/1993 | Japan . | |
| 5-78801 | 3/1993 | Japan . | |
| 6-41713 | 2/1994 | Japan | C23C 4/04 |
| 6-330278 | 11/1994 | Japan | C23C 4/04 |
| 6-330278 | 12/1994 | Japan | C23C 4/04 |
| 7-268594 | 10/1995 | Japan | C23C 4/10 |
| 7-26894 | 10/1995 | Japan | C23C 4/10 |
| WO 93/11277 | 6/1993 | WIPO | C23C 18/00 |

OTHER PUBLICATIONS

Naruse, Sei, "Glass Technology", 1st Ed., 16th print, Kyoritu Shuppan, K.K., p. 264, Feb. 5, 1976.

*Primary Examiner*—Shrive Beck
*Assistant Examiner*—Michael Barr
*Attorney, Agent, or Firm*—Austin R. Miller

[57] ABSTRACT

A composite steel sheet including a steel base member; an undercoat having opposed surfaces and a thickness of 10–750 $\mu$m obtained by spraying one or more spraying materials selected from metals, non-oxide ceramics, oxide ceramics and cermets onto the steel base member. The undercoat has an oxide layer of not less then 0.5 $\mu$m in thickness on one of the opposed surfaces positioned away from said steel base member. A fired topcoat is formed on the oxide layer of the undercoat from a vitreous coating having a linear expansion coefficient of $4–11\times10^{-6}/°C$.

11 Claims, No Drawings

MEMBER HAVING COMPOSITE COATING AND PROCESS FOR PRODUCING THE SAME

TECHNICAL FIELD

This invention relates to a member having a composite coating obtained by laminating a thermally sprayed coating and a vitreous film and a process for producing the same, and more particularly to a member provided with a composite coating having not only improved corrosion resistance and resistance to molten metal but also improved heat resistance and resistance to thermal shock.

BACKGROUND ART

A plated layer such as galvanized coating, hot-dip aluminum coating, hot-dip zinc-aluminum alloy coating or the like develops excellent rust proof power and corrosion proof power, so that it is a surface treated coating used as a member for automobile, aircraft, vehicle, building, household electrical articles and the like.

Among them, the galvanized steel sheets are generally produced by subjecting a surface of a steel sheet to a galvanizing treatment in a continuous galvanizing apparatus. In the continuous galvanizing apparatus are used members for molten metal bath such as a sink roll immersed in a plating bath, a support roll arranged near to the surface of the plating bath, guide rolls for guiding a plated steel sheet passed through these rolls and so on. These members are immersed in a plating bath, or placed in a place to easily be adhered with scattered hot-dip zinc and also used so as to contact with a high temperature steel sheet adhered with the hot-dip zinc, so that they are required to have the following properties.

(1) It is difficult to cause penetration through hot-dip zinc;
(2) It is difficult to cause wearing even when being contacted with a passing plate (steel sheet);
(3) The peeling of the hot-dip zinc adhered and the inspection for maintenance are easy;
(4) The life as a member for plating is long and the cost is low;
(5) It is sufficiently durable to thermal shock in the immersion in to a high-temperature hot-dip zinc bath.

In order to satisfy the above requirements, taking a coating for sink roll, there are proposed the followings:

(1) the formation of a coating having an alloy composition according to Co-based self-fluxing alloy defined in JIS H8303(1976) as disclosed in JP-B-56-39709, JP-B-58-11507, JP-A-59-153875, JP-A-1-108334, JP-A-64-79356 and JP-A-2-125833;
(2) the formation of spray coating of oxide ceramics comprising $ZrO_2$ and $Al_2O_3$ as disclosed in JP-A-61-117260, JP-B-3-54181 and JP-B-4-27290;
(3) the formation of cermet spray coating in which a metal such as Cr, Ni, Co or the like is co-existent in a non-oxide ceramics such as carbide, nitride, boride or the like as disclosed in JP-B-58-37386, JP-A-2-212366, JP-A-2-180755, JP-A-3-94048, JP-A-4-13857 and JP-A-4-346640;
(4) a combination of techniques of the above items (1) and (3) as disclosed in JP-A-4-13857;
(5) overlaying of anti-fusion metal disclosed in JP-B-52-22934, spray coating of W disclosed in JP-A-53-128538, spray coating of Cr disclosed in JP-A-165058 and the like.

In connection with the above techniques, the inventors have studied and developed the same kind of the technique. For example, there are proposed the following techniques and coatings:

(6) spray coating of WC cermet containing 5–28% of Co and having a porosity of not more than 1.8% and a thickness of 0.040-less than 0.10 mm in Japanese Patent Application No. 63-49846 (JP-A-1-225761);
(7) a technique of subjecting boride or a boride material containing 5–28% of Co to a plasma spraying under a reduced pressure in Japanese Patent Application No. 63-192753 (JP-A-2-43352);
(8) the formation of a coating having a surface roughness Ra of 0.01–5 $\mu$m and a porosity of not more than 1.8% by subjecting a material of $ZrB_2$, $TiB_2$ or various carbides containing 5–40% of Ta, Nb to a plasma spraying under a reduce pressure in Japanese Patent Application 1-54883 (JP-A-2-236266);
(9) a coating obtained by forming $Cr_3O_3$ onto a cermet spray coating consisting essentially of a carbide through chemical densification method in Japanese Utility Model Application No. 1-124010 (JP-Y-3-63565);
(10) a coating in which a part of a carbide spray coating is changed into a boride through boridation treatment in Japanese Patent Application No. 2-201187 (JP-A-4-88159);
(11) the improvement of resistance hot-dip zinc by diffusing Al or Al—Zn alloy into various carbides, borides or their cermet spray coatings under heating in Japanese Patent Application No. 3-31448 (JP-A-4-254571);
(12) a diffusion penetration of Al or Al—Zn alloy into non-oxide ceramic spray coating in Japanese Patent Application No. 3-31448 (JP-A-4-254571);
(13) a spray coating formed by using a spraying material constituted by adding Al or Al—Zn alloy to non-oxide ceramic powder or powder mixed with a metal in Japanese Patent Application No. 3-222425 (JP-A-4-358055);
(14) a spray coating formed by using a spraying material constituted by adding Al—Fe alloy or Al—Fe—Zn alloy to non-oxide ceramic powder or powder mixed with a metal in Japanese Patent Application No. 3-213143 (JP-A-5-33113);
(15) the formation of Al—Fe alloy layer having an Al content of not less than 22% on a surface of a steel roll in Japanese Patent Application No. 3-266874 (JP-A-5-78801).

In this connection, the inventors have found that there are still the following problems to be solved as to the resistance to molten metal in the above spray coatings. That is, (1) In the spray coatings formed in air, pores are present and also oxides are incorporated therein. Therefore, even if the spray coating material is a substance not causing the metallurgical reaction with molten metal, the molten metal passing through the pore portion penetrates into the inside of the coating and reacts with a matrix metal to peel and break the coating from its base.
(2) Since a metal having a small oxide-forming energy as in molten aluminum reduces an oxide included in the coating (the spraying material is oxidized in a spray heating source and retained in the coating as it is), the pore is enlarged and the metallurgical reaction with the metal formed by reduction is caused to change the volume and break the coating.
(3) The carbide cermet exemplified by WC—Co or the like is used as a spray coating for a anti-fusion metal. However, molten metal adheres to a metal component included in the coating or metallurgically reacts therewith to promote the sticking of dross component and finally lower the quality of the plated steel sheet.

(4) The spray coated members used in a molten metal bath are required to have a heat resistance and a strong resistance to thermal shock because they are used under a high-temperature environment.

It is a main object of the invention to provide members developing excellent effects when being applied to a member for anti-fusion metal, particularly members provided with a composite coating having excellent corrosion resistance and resistance to molten metal.

Further, it is another object of the invention to propose a structure of a composite coating being large in the resistance to peel or breakage of the coating and having excellent heat resistance and resistance to thermal shock.

It is the another object of the invention to solve the aforementioned problems and to provide members developing an excellent corrosion resistance to acid, alkali aqueous solution, molten salts such as chloride, sulfate, nitrate and the like and capable of being advantageously used under such corrosive environment.

It is a further object of the invention to provide a method of efficiently forming the above composite coating on a surface of a steel base member.

DISCLOSURE OF INVENTION

In order to solve the aforementioned problems, the invention fundamentally adopts the following means.

At first, a spray coating of an oxide ceramic, a non-oxide ceramic or a cermet made from these ceramics and various metals is formed on a surface of a steel base member as an undercoat, and then a vitreous coating is laminated on the spray coating as a topcoat to form a composite coating. And also, an oxide layer having a given thickness is arranged on the spray coating or a surface of the spray coating facing the vitreous coating to improve the adhesion property between the spray coating and the vitreous coating component as an upper layer through adequate unevenness and pores of the oxide layer.

Furthermore, according to the invention, a linear expansion coefficient of the vitreous coating is made within a range of $4–11\times10^{-6}$/°C., whereby a composite coating having a good resistance to thermal shock is obtained.

A point and construction of the invention will be described in detail further.

1. That is, the invention lies in a member provided with a composite coating, characterized in that a spry coating is formed on a surface of a steel base member as an undercoat and a vitreous coating is formed thereon as a topcoat and the spray coating has an oxide layer at its side facing the vitreous coating.
2. In the invention, the spray coating formed as an undercoat is formed by spraying at least one or more spraying material selected from metals, oxide or non-oxide ceramics and their cermets.
3. In the invention, the spray coating is a coating formed by subjecting the spraying materials alone or in admixture to spraying in form of one layer or plural layers.
4. In the invention, the spray coating of the plural layers has a structure of two or more layers by spraying different spraying materials.
5. In the invention, the spray coating has a thickness of 10–750 $\mu$m.
6. In the invention, the oxide layer formed on the surface side of the spray coating has a thickness of not less than 0.5 $\mu$m.
7. In the invention, the vitreous coating formed as a topcoat is formed by heating a vitreous starting material consisting essentially of one or more glass-forming oxides selected from $SiO_2$, $Na_2O$, $K_2O$, BaO, $B_2O_3$, MgO, CaO, PbO, CoO, $MnO_2$, NiO, $TiO_2$ and ZnO and glass ceramics and porcelain enamel, or immersing into a bath of these molten vitreous starting materials.
8. A member provided with a composite coating according to claim 1, wherein the vitreous coating has a linear expansion coefficient of $4–11\times10^{-6}$/°C.
9. A method of producing am ember provided with a composite coating excellent corrosion resistance and resistance to molten metal, characterized in that at least one spraying material selected from metals, ceramics and cermets thereof is sprayed alone or in admixture onto a surface of a steel base member in form of a one layer or plural layers to form a spray coating, and then a vitreous starting material is applied onto the surface of the spray coating and is fired at 500–1000° C. for 0.5–10 hours or immersed in a bath of molten vitreous starting material and fired to form a vitreous coating and is composited with the spray coating.
10. In the invention, the spray coating as an undercoat is formed by spraying different spraying materials to form two or more layers.
11. In the invention, after the formation of the spray coating, an oxide layer is formed on the surface of the spray coating by heating the coating.

BEST MODE FOR CARRYING OUT THE INVENTION

The construction of the invention will be described in detail according to working steps for forming a composite coating having excellent corrosion resistance, resistance to molten metal and the like onto a surface of a steel base member.

(1) Formation of Spray Coating as an Undercoat

The surface of the steel base member is degreased and subjected to a roughening treatment through grid blast and then a metal, oxide or non-oxide ceramics, or oxide or non-oxide cermet is sprayed onto the surface of the member through a spraying method to form a spray coating of one or more layers having a thickness of 30–750 $\mu$m.

When the thickness of the spray coating is less than 30 $\mu$m, the function as the undercoat is poor, while when it exceeds 750 $\mu$m, it is disadvantageous in view of economic reasons. Desirably, the range of 50–250 $\mu$m is recommended from a viewpoint of the function of the undercoat and the economic reasons.

As a spraying material for the formation of the spray coating, use may be made of the followings:

① as a metal material, there are Ni, Fe, Mo, Cr, Co, Ti, Nb, Si, Al, W and alloys thereof;

② as a ceramic material, there are the following one ceramic or a mixture of two or more ceramics;

a. oxides such as $Al_2O_3$, $TiO_2$, MgO, $ZrO_2$, $Ta_2O_5$, $Nb_2O_5$, $SiO_2$ and the like;

b. carbides such as WC, $Cr_3C_2$, NbC, TaC, HfC, MoC, ZrC, TiC and the like;

c. borides such as $NiB_2$, $CrB_2$, $W_2B_5$, $TiB_2$, $ZrB_2$, $NbB_2$, $TaB_2$ and the like;

d. nitrides such as TiN, VN, NbN, TaN, HfN, ZrN, BN, $Si_3N_4$, CrN and the like;

③ as a cermet material, there is a mixed powder or sintered powder of the metal material of the item ① and the ceramic material of the item ②.

Furthermore, the metal material, ceramic material and cermet material as the spraying material may be used alone or in admixture to form the undercoat of a single layer or plural layers, but two-layer structures may be formed by a combination of, for example, the metal material/oxide ceramic material.

As the spraying method, use may be made of anyone of plasma method, method of using combustion flame of combustible gas or explosion energy of combustible gas, and method of using arc through direct current or the like as a heat source.

(2) Formation of Vitreous Coating as a Topcoat

The spray coating formed as the undercoat has an adequate roughness at its surface and includes pores inherent to the spray coating. In the invention, therefore, a vitreous coating is formed on the surface of the undercoat as a topcoat by utilizing the characteristics of the undercoat.

The vitreous coating as the topcoat is formed by applying or spraying powder of vitreous material such as frit or the like and, if necessary, added with a starting sub-material to the member and then firing in a heating furnace at 500–1000° C. for 0.5–10 hours, or by immersing the member in a bath of molten glass or porcelain enamel and then taking out therefrom to conduct the coating formation.

The thus formed vitreous coating is joined at a strong adhesion force so as to well adapt to the adequate roughness (5–200 $\mu$m) and pores (0.5–20%) in the surface of the spray coating. That is, glass in a molten state flows into recesses portion formed in the surface of the spray coating and penetrates into the inside thereof through the pores, so that both the coatings are strongly joined to each other through anchor action and exhibit good adhesion property.

Further, the vitreous coating used as a topcoat in the invention has a linear expansion coefficient of $4–11\times10^{-6}$/°C. In general, the steel base member has a linear expansion coefficient of $10–18\times10^{-6}$/°C. On the other hand, the undercoat (spray coating) formed on the surface of the base member is usually fairly small in the linear expansion coefficient because it actually contains oxide and pores even in the case of a metal indicating a large value ($23.5\times10^{-6}$/°C. such as Al. Therefore, the linear expansion coefficient of the base member becomes near to that of the undercoat, so that peeling is not caused even against the heat change after the formation of the coating. Particularly, the presence of the spray coating serves as a buffer for the topcoat formed thereon with respect to thermal expansion property.

When the linear expansion coefficient of the topcoat (vitreous coating) is selected within a range of $4–11\times10^{-6}$/°C. in addition to the action of the above undercoat (spray coating), there is obtained a composite coating having a better adhesion property. In this way, there is not caused the peeling of the topcoat from the undercoat or the occurrence of cracks in the topcoat.

The reason why the linear expansion coefficient of the topcoat being the vitreous coating is limited to the above range is due to the fact that when it is less than $4\times10^{-6}$/°C., cracks are apt to be created when being immersed in a high-temperature hot-dip zinc plating bath (460–480° C.), while when the linear expansion coefficient exceeds $11\times10^{-6}$/°C., the production of the topcoat is technically difficult and is not practical.

In the invention, a greatest merit using the spray coating as the undercoat lies in that the spraying particles constituting the coating includes oxide and is excellent in the bonding property to the vitreous coating (including porcelain enamel obtained by firing of fit) as the topcoat.

For example, not only the spray coating of oxide ceramics but also the spray coating of metal-alloy, carbide spray coating and nitride spray coating produce oxides in varying degrees as far as the spraying is carried out in air, which are good in the wettability to the frit and improves a chemical bonding force. In the invention, therefore, it is necessary that all of the spraying materials are sprayed in air or in an oxygen existing atmosphere to form a spray coating including an oxide layer on at least a surface thereof.

In this connection, according to the invention, it is favorable to positively produce the oxide layer by heating the spray coating at a temperature of 300–600° C. after the formation of the spray coating as the undercoat.

Moreover, the oxide layer formed as the surface layer of the spray coating is boundary portion to be joined with the vitreous coating) is effective to have a thickness of not less than 0.5 $\mu$m, preferably 1–3 $\mu$m.

In order to confirm that the frit (starting glass material) is good in the wettability with the oxide as mentioned above, the inventors have made the following experiment.

(a) After Ni(80)-Cr(20) alloy was sprayed onto a surface of a test piece of SUS 430L (ferritic stainless steel) in an atmosphere of Ar gas substantially containing no air, powder of frit having a composition of 1 wt % $K_2O$-8 wt % $Na_2O$-1 wt % CoO-2 wt % NiO-5 wt % $B_2O_3$-83 wt % $SiO_2$ was applied thereonto and fired at 900°×1 hour to form a composite coating.

(b) After Ni(80)-Cr(20) alloy was sprayed in air, the same frit powder as in the item (a) was fired to form a composite coating.

(c) After 73 wt % $Cr_3Cr_2$-20 wt % Ni-7 wt % Cr was sprayed in air, the same frit powder as in the item (a) was fired to form a composite coating.

(d) After 100 wt % TiN was sprayed in air, the same frit powder as in the item (a) was fired to form a composite coating.

(e) After 80 wt % Ni-19 wt % Cr-0.5 wt % Al-0.5 wt % Si was sprayed in air, the resulting spray coating was subjected to a heating treatment at 500° C.×15 minutes and the same frit powder as in the item (a) was fired thereon to form a composite coating.

The experiment was carried out by repeating an operation of heating each of the above five composite coatings at 600° C. for 15 minutes and charging into water of 25° C. The results were as follows.

Composite coating (a) . . . local peeling at the repetition of 2 times

Composite coatings (b), (c), (d), (e) . . . normal even at the repetition of 5 times Further, the experiment was continued to obtain results as follows.

Composite coating (b) . . . local peeling at the repetition of 7 times

Composite coatings (c), (d), (e) . . . normal even at the repetition of 10 times That is, it is clear that the spray coating containing oxide is excellent in the adhesion property to the frit, which it utilized in the composite coating according to the invention.

Moreover, the thickness of the oxide film formed on the Ni(80)-Cr(20) alloy coating in air is within a range of 0.05–0.2 $\mu$m. When the alloy coating is heated, the oxide film grows to a thickness of 0.5–3 $\mu$m, whereby the adhesion property to the frit powder (vitreous) is further improved.

As the material for the vitreous coating used in the invention, the following glass-forming oxides as a frit material are effective.

(1) it consists essentially of vitreous one: $Na_2O$, $K_2O$, BaO, $B_2O_3$, $SiO_2$, MgO, CaO, PbO (2) it consists essentially of $SiO_2$, $Al_2O_3$, $B_2O_3$, CaF, $Na_2O$, $K_2O$ using a porcelain starting material such as natural feldspar, natural silica, soda ash ($Na_2CO_3$), boride sand ($Na_2B_2O_7$) or the like and contains CoO, MnO, NiO, $TiO_2$, ZnO or the like as a slight component.

The adjustment of linear expansion coefficient of the frit material is carried out by mainly controlling the content of $SiO_2$, $K_2O$ and $Na_2O$. That is, as the $SiO_2$ content increases, the linear expansion coefficient becomes small, while as the alkali component increases, the linear expansion coefficient becomes large.

After the above adjustment, the frit powder is added with an organic binder such as isoamyl acetate, isopropyl alcohol, nitrocellulose or the like, which may be applied by spraying onto the surface of the spray coating as the undercoat. Thereafter, it is dried at 110–120° C. for 0.5–2 hours to remove water through evaporation. Then, it rises to 300–400° C. to remove the organic binder through combustion and further heated to a melting point of the frit material (usually 500–950° C.) to completely bond the undercoat to the topcoat, whereby the composite coating according to the invention is obtained.

EXAMPLES

Example 1

In this example, there was investigated optimum thickness of a topcoat (vitreous coating) formed on undercoats (spray coatings) of various materials.

1. Matrix to be tested: SUS 410L (ferritic stainless steel) was finished into a diameter of 20 mm and a length of 200 mm.
2. Material and thickness of spray coating as an undercoat
   - 2-1 80 wt % Ni-20 wt % Cr was shaped into a thickness of 100 μm by plasma spraying.
   - 2-2 After 80 wt % Ni-20 wt % Cr was shaped into a thickness of 50 μm by plasma spraying, 60 wt % $Al_2O_3$-40 wt % $TiO_2$ was shaped into a thickness of 100 μm by plasma spraying as two layers.
   - 2-3 73 wt % $Cr_3C_2$-20 wt % Cr-7 wt % Ni was shaped into a thickness of 100 μm by high-speed flame spraying.
   - 2-4 88 wt % WC-12 wt % Co was shaped into a thickness of 100 μm by high-speed flame spraying.

Moreover all of these spray coatings included an oxide layer of not less than 0.5 μm on at least their surfaces.

3. Frit material and thickness for vitreous coating as a topcoat
   - 3-1 10 wt % $B_2O_3$-25 wt % $Na_2O$-5 wt % CaO-60 wt % $SiO_2$
   - 3-2 8 wt % ZnO-18 wt % CaO-10 wt % $Ba_2O_3$-64 wt % $SiO_2$ To the frit was added 0.2 wt % of a mixture of isoamyl acetate and nitrocellulose as a kneading assist, which were well kneaded and applied to the spray coating at a thickness of 10 μm, 50 μm, 100 μm, 250 μm, 500 μm, 750 μm, 1000 μm, 1500 μm, or 2000 μm and thereafter fired in an electric furnace under conditions of 900° C.×1 hour.

(The same steps were carried out with respect to the following examples.)

4. Evaluation method

The test piece produced in the above steps was subjected to a cycle of heating in an electric furnace at 600° C. for 15 minutes and then charging and cooling in water at 25° C. and repeated 20 times to visually observe the presence of absence of cracks and peel produced in the topcoat.

5. Test results

The test results of the composite coating obtained by firing the frit having a composition of 10 wt % $B_2O_3$-25 wt % $Na_2O$-5 wt % CaO-60 wt % $SiO_2$ are shown in Table 1, and the test results of the composite coating obtained by firing the frit having a composition of 8 wt % ZnO-18 wt % CaO-10 wt % $B_2O_3$-64 wt % $SiO_2$ are shown in Table 2.

As seen from these results, when the thickness of the vitreous coating is 10–750 μm, there is no occurrence of slight cracking even in the 20 cycles of heating-cooling and a sound state is exhibited irrespectively of the kind of the spray coating material.

On the contrary, when the thickness of the vitreous coating is 1000–2000 μm, slight cracks are created and the number and size of the cracks increases as the thickness becomes large and local peeling is observed at 2000 μm.

The above results shows the same tendency even in the vitreous coatings using two kinds of the frit materials, from which it is confirmed that the thickness of the vitreous coating used for the object of the invention is suitable within a range of 10–750 μm.

TABLE 1

| | Thickness of vitreous coating | Spray coating (undercoat) | | | |
|---|---|---|---|---|---|
| No. | μm | 80Ni-20Cr | $73Cr_3C_2$-27NiCr | 88WC-12Co | Remarks |
| 1 | 10 | 20 times no abnormal state | 20 times no abnormal state | 20 times no abnormal state | Acceptable Example |
| 2 | 50 | 20 times no abnormal state | 20 times no abnormal state | 20 times no abnormal state | |
| 3 | 100 | 20 times no abnormal state | 20 times no abnormal state | 20 times no abnormal state | |
| 4 | 250 | 20 times no abnormal state | 20 times no abnormal state | 20 times no abnormal state | |
| 5 | 500 | 20 times no abnormal state | 20 times no abnormal state | 20 times no abnormal state | |
| 6 | 750 | 20 times no abnormal state | 20 times no abnormal state | 20 times no abnormal state | |
| 7 | 1000 | occurence of fine crack | occurence of fine crack | occurence of fine crack | Comparative Example |
| 8 | 1500 | many fine cracks | many fine cracks | many fine cracks | |
| 9 | 2000 | local peel | local peel | local peel | |

(Remarks)
(1) As the vitreous coating, frit of 10 wt % $B_2O_3$-25 wt % $Na_2O$-5 wt % CaO-60 wt % $SiO_2$ is used. Linear expansion coefficient: $5.9 \times 10^{-6}$/° C.
(2) Numerical values of the spray coating are represented by wt %.

TABLE 2

| No. | Thickness of vitreous coating μm | Spray coating (undercoat) 80Ni-20Cr | 73$Cr_3C_2$-27NiCr | 88WC-12Co | Remarks |
|---|---|---|---|---|---|
| 1 | 10 | 20 times no abnormal state | 20 times no abnormal state | 20 times no abnormal state | Acceptable Example |
| 2 | 50 | 20 times no abnormal state | 20 times no abnormal state | 20 times no abnormal state | |
| 3 | 100 | 20 times no abnormal state | 20 times no abnormal state | 20 times no abnormal state | |
| 4 | 250 | 20 times no abnormal state | 20 times no abnormal state | 20 times no abnormal state | |
| 5 | 500 | 20 times no abnormal state | 20 times no abnormal state | 20 times no abnormal state | |
| 6 | 750 | 20 times no abnormal state | 20 times no abnormal state | 20 times no abnormal state | |
| 7 | 1000 | occurence of fine crack | occurence of fine crack | occurence of fine crack | Comparative Example |
| 8 | 1500 | many fine cracks | many fine cracks | local peel | |
| 9 | 2000 | local peel | local peel | local peel | |

(Remarks)
(1) As the vitreous coating, frit of 8 wt % ZnO-18 wt % CaO-10 wt % $B_2O_3$-64 wt % $SiO_2$ is used. Linear expansion coefficient: $6.8 \times 10^{-6}$/° C.
(2) Numerical values of the spray coating are represented by wt %.

Example 2

In this example, the coating according to the invention was immersed in a hot-dip zinc bath to investigate resistance to hot-dip zinc. At the same time, the test piece taken out from the hot-dip zinc bath was charged into water at 20° C. to evaluate the resistance to thermal shock.

1. Matrix tested: the same as in Example 1
2. Spraying material and thickness of undercoat The kind and thickness of the spraying material were the same as in Example 1.

3. Frit material for vitreous coating as a topcoat and thickness thereof

The kind of the frit material was the same as in Example 1. The thickness is 100 μm.

4. Evaluation method 4.1 Zinc bath condition: Zn Bath containing 0.1 wt % of Al 480° C.

4.2 Immersion time in zinc bath: 24 hours. Thereafter, it is charged into water of 20° C. Such an operation is one cycle and repeats 10 times After the completion of the above test, the appearance of the coating was visually observed to investigate the adhesion state of zinc, and presence or absence of cracks and peeling in the coating.

5. Comparative coating

As a comparative coating for the topcoat, a coating not forming the vitreous coating was used, which was repeatedly subjected to the cycle of immersion in zinc bath←→charge into water 10 times.

6. Test results

The test results are summarized in Table 3. As seen from these results, in the comparative example (No. 3) not firing the frit, the metallurgical reaction between hot-dip zinc and coating was caused to bring about corrosion, or when the coating such as $Al_2O_3$—$TiO_2$ coating did not react with zinc, zinc penetrated into the inside through pores existing in the coating to corrode the undercoat coating and hence there was observed a phenomenon of breaking the coating from its base.

On the contrary, when the composite coating of the undercoat and the topcoat (①,②) was formed by the method according to the invention, the frit did not essentially react hot-dip zinc and had no pores, so that there was caused no penetration of zinc into the inside. Therefore, zinc was physically and thinly adhered onto the surface of the composite coating taken out from the zinc bath, but can simply be removed by finger and the surface of the composite coating in the removed portion is very smooth.

Further, when it was repeatedly subjected to immersion in hot-dip zinc and charge into water 10 times, there was not observed an abnormal state in the composite coating.

TABLE 3

| No. | Kind of vitreous coating | Spray Coating (undercoat) 80Ni-20Cr | ①80Ni-20Cr ②60$Al_2O_3$-40$TiO_2$ | 73$Cr_3C_2$-27NiCr | 88WC-12Co | Remarks |
|---|---|---|---|---|---|---|
| 1 | ① | slight adhesion of zinc | slight adhesion of zinc | slight adhesion of zinc | slight adhesion of zinc | Acceptable Example |
| 2 | ② | slight adhesion of zinc | slight adhesion of zinc | slight adhesion of zinc | slight adhesion of zinc | |

TABLE 3-continued

| No. | Kind of vitreous coating | Spray Coating (undercoat) 80Ni-20Cr | ①80Ni-20Cr ②$60Al_2O_3$-40$TiO_2$ | $73Cr_3C_2$-27NiCr | 88WC-12Co | Remarks |
|---|---|---|---|---|---|---|
| 3 | none | large erosion of spray coating | large erosion of undercoat | local breakage of coating | large adhesion of zinc | Comparative Example |

(Remarks)
(1) results after 10 cycles as a cycle of hot-dip zinc bath temperature: 480° C. and immersion time: 24 h
(2) Kind and composition of vitreous coating
①10 wt % $B_2O_3$-25 wt % $Na_2O$-5 wt % CaO-60 wt % $SiO_2$
②8 wt % ZnO-18 wt % CaO-10 wt % $B_2O_3$-64 wt % $SiO_2$
(3) Numerical values of the spray coating is represented by wt %.

Example 3

In this example, the coating according to the invention was immersed in hot-dip zinc bath-aluminum alloy bath and molten aluminum bath to investigate the resistance to molten metal and resistance to thermal shock.

1. Matrix tested: the same as in Example 1
2. Spraying material for undercoat and thickness thereof The kind of the spraying material and the thickness of the coating were the same as in Example 1.

3. Vitreous coating as a topcoat and thickness thereof

The kind of the frit material was the same as in Example 1. The thickness was 100 μm.

4. Evaluation method

Immersion conditions:

① 45 wt % Zn-55 wt % Al, 605° C.

② 8 wt % Si-92 wt % Al, 680° C.

The test piece was repeatedly subjected to one cycle of immersing in each of both the baths for 24 hours and charged into water of 20° C. 10 times.

After the completion of the test, the appearance of the coating was visually investigated with respect to the adhesion state of molten metal and the presence or absence of cracks and peeling in the coating.

5. Comparative coating

A coating not forming the vitreous coating as a topcoat was tested under the same conditions for comparison 6. Test results The test results are summarized in Table 4. As seen from these results, when all coatings of the comparative examples were immersed in 45 wt % Zn-55 wt % Al alloy bath or 8 wt % Si-92 wt % Al bath, they were corroded by molten metal over approximately a full surface at 1–2 cycles. On the contrary, the composite coatings according to the invention observe the adhesion of molten metal but the adhered coating may easily be removed by finger and there was not observed an abnormal state on the surface of the composite coating in the removed portion. Furthermore, the occurrence of cracks in the composite coating through thermal shock was not visually observed.

TABLE 4

| No. | Kind of vitreous coating | Kind of molten metal | Spray Coating (undercoat) 80Ni-20Cr | ①80Ni-20Cr ②$60Al_2O_3$-40$TiO_2$ | $73Cr_3C_2$-27NiCr | 88WC-12Co | Remarks |
|---|---|---|---|---|---|---|---|
| 1 | $B_2O_3$ 10 wt %<br>$Na_2O$ 25 wt %<br>CaO 5 wt % | 45Zn-55Al | slight adhesion of metal | slight adhesion of metal | slight adhesion of metal | slight adhesion of metal | Acceptable Example |
| 2 | $SiO_2$ 60 wt % | 8Si-92Al | slight adhesion of metal | slight adhesion of metal | slight adhesion of metal | slight adhesion of metal | |
| 3 | ZnO 8 wt %<br>CaO 18 wt % | 45Zn-55Al | slight adhesion of metal | slight adhesion of metal | slight adhesion of metal | slight adhesion of metal | |
| 4 | $B_2O_3$ 10 wt %<br>$SiO_2$ 64 wt % | 8Si-92Al | slight adhesion of metal | slight adhesion of metal | slight adhesion of metal | slight adhesion of metal | |
| 5 | none | 45Zn-55Al | large erosion of coating at first immersion | erosion of coating at second immersion | erosion of coating at second immersion | erosion of coating at second immersion | Comparative Example |
| 6 | | 8Si-92Al | large erosion of coating at first immersion | erosion of coating at second immersion | erosion of coating at first immersion | erosion of coating at first immersion | |

(Remarks)
(1) Temperature of 45 wt % Zn-55 wt % Al alloy bath was 605° C., and temperature of 8 wt % Si-92 wt % Al alloy bath was 680° C.
(2) Numerical values of the spray coating are represented by wt %.

Example 4

In this example, when the coating according to the invention was immersed in hot-dip zinc bath and then taken out therefrom, thin zinc coating was adhered to the coating. This zinc coating could simply and mechanically be peeled off, but it was investigated with respect to a method of chemically dissolving and removing it.

1. Matrix tested: the same as in Example 1
2. Spraying material for undercoat and thickness thereof To the same spraying material as in Example 1 is added 100 wt % TiN and the coating thickness was 150 $\mu$m.

3. Vitreous coating as a topcoat and thickness thereof

The kind of the frit material was the same two kinds as in Example 1 and the following two kinds to be 4 kinds in total and the thickness thereof was 150 $\mu$m.

3-1 8 wt % $B_2O_3$-6 wt % $ZrO_2$-84 wt % $SiO_2$ 3-2 2 wt % $Al_2O_3$-10 wt % $B_2O_3$-5 wt % MgO-87 wt % $SiO_2$

4. Evaluation method it reacted with zinc to develop the erosion phenomenon and a great amount of zinc was adhered to the test piece taken out from the bath. When the test piece at such a state was immersed in 5 wt % HCl and 5 wt % NaOH, zinc eluted while generating hydrogen gas even in both cases. This was due to the fact that zinc is a metalloid causing a chemical reaction with either acid or alkali.

In the surface dissolving out zinc, the coating eroded with zinc was exposed and floated up by the action of hydrogen gas generated in the elution of zinc to finally cause the peeling. It is confirmed that such a tendency is strong in HCl rather than NaOH.

On the contrary, the composite coating according to the invention subjected to the frit coating as a topcoat is not eroded by hot-dip zinc. Further, zinc thinly adhered after the taking out from the hot-dip zinc bath can simply be dissolved and removed by HCl and NaOH and the removed surface is not in an abnormal state and is sound.

TABLE 5

| | | | Spray coating and chemicals | | | | | | | | | | |
|---|---|---|---|---|---|---|---|---|---|---|---|---|---|
| | | | 5 wt % HCl 25° C. × 24 h | | | | | 5 wt % NaOH 25° C. × 24 h | | | | | |
| No. | kind of vitreous coating | | 80Ni-20Cr | ①80Ni-20Cr ②60$Al_2O_3$-40$TiO_2$ | 73Cr3C2-27NiCr | 88WC-12Co | 100TiN | 80Ni-20Cr | ①80Ni-20Cr ②60$Al_2O_3$-40$TiO_2$ | 73Cr3C2-27NiCr | 88WC-12Co | 100TiN | Remarks |
| 1 | $B_2O_3$ | 10 wt % | no | no | no | no | no | no | no | no | no | no | Acceptable |
| | $Na_2O$ | 25 wt % | ab- | ab- | ab- | ab- | ab- | ab- | ab- | ab- | ab- | ab- | Example |
| | CaO | 5 wt % | normal | normal | normal | normal | normal | normal | normal | normal | normal | normal | |
| | $SiO_2$ | 60 wt % | state | state | state | state | state | state | state | state | state | state | |
| 2 | ZnO | 8 wt % | no | no | no | no | no | no | no | no | no | no | |
| | CaO | 18 wt % | ab- | ab- | ab- | ab- | ab- | ab- | ab- | ab- | ab- | ab- | |
| | $B_2O_3$ | 10 wt % | normal | normal | normal | normal | normal | normal | normal | normal | normal | normal | |
| | $SiO_2$ | 64 wt % | state | state | state | state | state | state | state | state | state | state | |
| 3 | $B_2O_3$ | 8 wt % | no | no | no | no | no | no | no | no | no | | |
| | $ZrO_2$ | 6 wt % | ab- | ab- | ab- | ab- | ab- | ab- | ab- | ab- | ab- | ab- | |
| | $SiO_2$ | 84 wt % | normal | normal | normal | normal | normal | normal | normal | normal | normal | normal | |
| | | | state | state | state | state | state | state | state | state | state | state | |
| 4 | $Al_2O_3$ | 2 wt % | no | no | no | no | no | no | no | no | no | | |
| | $B_2O_3$ | 10 wt % | ab- | ab- | ab- | ab- | ab- | ab- | ab- | ab- | ab- | ab- | |
| | MgO | 5 wt % | normal | normal | normal | normal | normal | normal | normal | normal | normal | normal | |
| | $SiO_2$ | 87 wt % | state | state | state | itate | state | state | state | state | state | state | |
| 5 | none | | 80% peel of spray coating | 30% peel of spray coating | 20% peel of spray coating | 35% peel of spray coating | 25% peel of spray coating | 5% peel of spray coating | 8% peel of spray coating | 10% peel of spray coating | 3% peel of spray coating | 2% peel of spray coating | Comparative Example |

(Remarks)
(2) Numerical values of the spray coating and chemical agent are represented by wt %.

The thus obtained coating according to the invention was immersed in a hot-dip zinc bath at 480° C. for 24 hours and then taken out therefrom and cooled and thereafter immersed in a the following chemical agent for 24 hours to dissolve and remove zinc from the coating and investigate the coating according to the invention on the resistance to chemicals.

4-1 5 wt % HCl 25° C.

4-2 5 wt % NaOH 60° C.

Moreover, only the undercoat spray coating not subjected to top coating was investigated under the same conditions as a comparative example.

5. Test results

The test results are summarized in Table 5. As seen from these results, in the case of only the spray coating not subjected to the frit coating as a comparative example, even if the coating was merely immersed in the hot-dip zinc bath, Example 5

In this example, the adhesion property of the topcoat was investigated when a metallic spray coating was formed as an undercoat and then a coating of oxide or boride was formed thereon.

1. Matrix tested: the same as in Example 1
2. Spraying material for undercoat and thickness thereof ① coating of 80 wt % Ni-20 wt % Cr at a thickness of 120 $\mu$m through plasma spraying in atmosphere ② a coating of 48 wt % MgO-52 wt % $Al_2O_3$ at a thickness of 30 $\mu$m formed the above Ni—Cr alloy spray coating through plasma spraying in atmosphere ③ a coating of 97 wt % $Cr_2O_3$-3 wt % $SiO_2$ at a thickness of 70 $\mu$m formed on the above Ni—Cr alloy spray coating through plasma spraying in atmosphere ④ a coating of 100 wt % $TiO_2$ at a thickness of 70 $\mu$m formed on the above N—Cr alloy spray coating through plasma spraying in atmosphere ⑤ a coating of 100 wt % $ZrB_2$ at a thickness of 100 μm formed on the above Ni—Cr alloy spray coating through plasma spraying in atmosphere ⑥ (Comparative Example) 80 wt % Ni-20 wt % Cr was plasma-sprayed at a thickness of 120 μm in 100 hpa of Ar gas atmosphere removing air by using a mixed gas of Ar and $H_2$ as a plasma actuating gas.

Moreover, all of the above spray coatings ①–⑤ had an oxide layer of 0.5 μm in thickness on at least their surfaces. However, the oxide layer was not present in the coating ⑥.

3. Vitreous coating at a topcoat and thickness thereof

① a coating of 8 wt % ZnO-18 wt % CaO-10 wt % $B_2O_3$-64 wt % $SiO_2$ was formed at a thickness of 30 μm (the treating method was the same as in Example 1).

4. Evaluation method

The change of the topcoat was observed by repeatedly subjecting the thus obtained test piece to an operation of heating at 650° C. for 15 minutes and charging into water of 25° C. 5 times.

5. Test results

The test results are summarized in Table 6. As seen from these results, 80 wt % Ni-20 wt % Cr alloy spray coating (No. ⑥) formed by using the mixed gas of Ar and $H_2$ as a plasma actuating gas in Ar gas atmosphere containing substantially no oxygen did not substantially contain the oxide layer between the undercoat and the topcoat, so that the joint strength between the spray coating and the vitreous coating was weak and the local peeling (4 places having a size of about 5×8 mm) are already created even at the second thermal shock test.

On the contrary, the coating of 80 wt Ni-20 wt % Cr alloy according to the invention formed in air (No. ①) formed the oxide layer (about 1 μm) by the reaction with oxygen at the joint boundary in the spraying, so that the joint strength therebetween was high and the abnormal state was not observed even after the thermal shock test was repeated 5 times.

Further, it has been confirmed that the coatings of Ni—Cr alloy and oxide ceramics formed thereon such as 48 wt % MgO-52 wt % $Al_2O_3$ (No. ②), 97 wt % $Cr_2O_3$-3 wt % $SiO_2$ (No. ③), 100 wt % $TiO_2$ (No. ④) and the like and further 100 wt % $ZrB_2$ (No. ⑤) develop good bonding force to the top vitreous layer as far as the oxide is formed on the surface of the sprayed particles through plasma spraying in air.

TABLE 6

| | Structure and thickness of coating | | | Test Results | |
|---|---|---|---|---|---|
| | Undercoat | | Topcoat | Appearance | Re- |
| No. | 80Ni-20Cr | ceramic | vitreous | state | marks |
| 1 | 120 μm | none | 30 μm | no abnormal state after 5 times | Accept-able |
| 2 | 120 μm | 48MgO-52$Al_2O_3$ 30 μm | 30 μm | no abnormal state after 5 times | Ex-ample |
| 3 | 120 μm | 97$Cr_2O_3$-3$SiO_2$ 70 μm | 30 μm | no abnormal state after 5 times | |
| 4 | 120 μm | 100 $TiO_2$ 70 μm | 30 μm | no abnormal state after 5 times | |
| 5 | 120 μm | 100 $ZrB_2$ 100 μm | 30 μm | no abnomal state after 5 times | |

TABLE 6-continued

| | Structure and thickness of coating | | | Test Results | |
|---|---|---|---|---|---|
| | Undercoat | | Topcoat | Appearance | Re- |
| No. | 80Ni-20Cr | ceramic | vitreous | state | marks |
| 6 | 120 μm | none | 30 μm | local peel of vitreous coating at 2 times | Com-para-tive Ex-ample |

(Remarks)
(1) thermal shock test conditions: 5 times of 650° C. × 15 minutes → charge into water of 25° C.
(2) composition of vitreous coating: 8 wt % ZnO-18 wt % CaO-10 wt % B2O3-64 wt % SiO2
(3) Numerical values of the spray coating are represented by wt %.

Example 6

In this example, there was investigated the adhesion property of the composite coating formed by spraying a metallic spraying material to form an undercoat, heating at 500° C. to positively form an oxide film on the surface and then forming a vitreous topcoat thereon.

1. Matrix tested: the same as in Example 1
2. Spraying material for undercoat and thickness thereof ① a coating of 80 wt % Ni-19 wt % Cr-0.5 wt % Al-0.5 wt % Si was formed at a thickness of 120 μm through plasma spraying in air and then heated at 500° C. for 15 minutes ② a coating of 48 wt % MgO-52 wt % $Al_2O_3$ was formed on the above alloy spray coating at a thickness of 30 μm (without heating).

Moreover, the oxide layer (0.8 μm) was present on the surface of the alloy spray coating ②.

3. Vitreous coating as a topcoat and thickness thereof

① a coating of 8 wt % Zn-18 wt % CaO-10 wt % $B_2O_3$-64 wt % $SiO_2$ was formed at a thickness of 30 μm (the treating method was the same as in Example 1).

4. Evaluation method

The evaluation was carried out by the same method as in Example 5.

5. Test results

The test results are summarized in Table 7. As seen from these results, the test coating (No. 1) obtained by positively forming the oxide film on the surface of the metallic spray coating as an undercoat according to the invention through heating did not exhibit the peeling of the topcoat even after 10 times of thermal shock. Further, the coating (No. 2) obtained by forming MgO—$Al_2O_3$ coating on the undercoat and forming the vitreous topcoat thereof was good.

Although the coating obtained by forming the vitreous topcoat on the undercoat of 80 wt % Ni-20 wt % Cr in Example 5 (table 6, test No. 1) was formed only through plasma spraying in air, the peeling of the vitreous topcoat was not caused even after the thermal shock test was repeated under the same conditions as in the invention 5 times as previously reported.

In the invention, the oxide film is positively formed on the surface of the spray coating and inside the pores thereof by heating the metallic undercoat. It is confirmed that the coating is durable to 10 times of thermal shock test by such a treatment.

Moreover, the test coating (No. 2) is considered to show a good adhesion property because the surface contacting with the vitreous topcoat is an oxide of MgO—$Al_2O_3$.

TABLE 7

| | Structure and thickness of coating | | | | |
|---|---|---|---|---|---|
| | Undercoat | | Topcoat | Test Results | |
| No. | metallic | ceramic | vitreous | Appearance state | Remarks |
| 1 | 80Ni-19Cr-0.5Al-0.55Si | none | 30 μm | no abnormal state after 10 times | Acceptable Example |
| 2 | 120 μm | $48MgO-52Al_2O_3$ 30 μm | 30 μm | no abnormal state after 10 times | |

(Remarks)
(1) thermal shock test conditions: heating at 650° C. for 15 minutes → charging into water of 25° C., 10 times
(2) composition of vitreous coating; 8 wt % ZnO-18 wt % CaO-10 wt % $B_2O_3$-64 wt % $SiO_2$
(3) numerical values of the spray coating are represented by wt %.
(4) As a coating of a comparative example, there is No. 6 in test result 6 of Example 5.

Industrial Applicability

As mentioned above, the member having the composite coating according to the invention comprises a steel base member and a composite coating comprised of an undercoat spray coating containing an oxide formed the surface thereon and a vitreous coating formed thereon by the firing of a frit material, so that it is excellent in the corrosion resistance, heat resistance and resistance to thermal shock.

Therefore, the composite coating according to the invention is favorably used in various rolls used in fields such as hot-dip zinc plating, hot-dip zinc-aluminum alloy plating, molten aluminum plating and the like, and as a member or molten metal bath such as shaft bearing, sleeve, bush, fitting for the adjustment of plating quantity or the like. Since the corrosion resistance is excellent, it is effective to use a member under environment of acid, alkali and molten salt.

What is claimed is:

1. A composite steel sheet comprising:

a steel base member;

an undercoat having a thickness of 10–750 μm obtained by spraying in air or an oxygen containing atmosphere on said steel base member one or more spray-materials selected from the group consisting of non-oxide ceramics and cermets thereof, said undercoat having an oxide layer of not less than 0.5 μm in thickness formed thereon by heating at a temperature of 300–600° C. after formation of the undercoat; and a fired topcoat formed on said oxide layer of said undercoat forming a vitreous coating having a linear expansion coefficient of $4–11\times10^{-6}$/°C.

2. The steel sheet according to claim 1, wherein the topcoat is formed from a vitreous starting material consisting essentially of one or more glass-forming oxides selected from the group consisting of $SiO_2$, $Na_2O$, $K_2O$, BaO, $B_2O_3$, MgO, CaO, PbO, CoO, $MnO_2$, NiO, $TiO_2$, ZnO, glass ceramics and porcelain enamel.

3. The steel sheet according to claim 1, wherein said non-oxide ceramics are selected from the group consisting of carbides, borides and nitrides.

4. The steel sheet according to claim 1, wherein said non-oxide ceramics are carbides selected from the group consisting of WC, $Cr_3C_2$, NbC, TaC, HfC, MoC, ZrC and TiC.

5. The steel sheet according to claim 1, wherein said non-oxide ceramics are borides selected from the group consisting of $NiB_2$, $CrB_2$, $W_2B_5$, $TiB_2$, $ZrB_2$, $NbB_2$ and $TaB_2$.

6. The steel sheet according to claim 1, wherein said non-oxide ceramics are nitrides selected from the group consisting of TiN, VN, NbN, TaN, HfN, ZrN, BN, $Si_3N_4$ and CrN.

7. The steel sheet according to claim 1, wherein the undercoat has a thickness of 50–250 μm.

8. The steel sheet according to claim 1, wherein the undercoat comprises two or more layers.

9. A method of producing a composite steel sheet having excellent corrosion resistance and resistance to molten metal comprising:

spraying a material selected from the group consisting of non-oxide ceramics and cermets thereof in air or an oxidizing atmosphere onto a steel base member and heating at a temperature of 300–600° C. after spraying to form a spray coating having an oxide layer of not less than 0.5 μm in thickness on a surface of said spray coating, which surface is spaced apart from said steel base member;

applying a vitreous starting material having a linear expansion coefficient of $4–11\times10^{-6}$/°C. onto the spray coating; and firing the vitreous starting material at 500–1000° C. for 0.5–10 hours to form a topcoat that is adhered to the spray coating.

10. The method of producing a composite steel sheet according to claim 9, wherein the vitreous starting material is applied by being sprayed onto the spray coating.

11. The method of producing a composite steel sheet according to claim 9, where the vitreous starting material is applied by immersion.

* * * * *

UNITED STATES PATENT AND TRADEMARK OFFICE

CERTIFICATE OF CORRECTION

PATENT NO. : 6,129,994
APPLICATION NO. : 08/894911
DATED : October 10, 2000
INVENTOR(S) : Harada et al.

It is certified that error appears in the above-identified patent and that said Letters Patent is hereby corrected as shown below:

In column 8, at Table 1, please insert column 4 after column 3 as follows:

-- ① 80Ni-20Cr
② 60 $Al_2O_3$-40$TiO_2$
20 times no abnormal state
20 times no abnormal state
20 times no abnormal state
20 times no abnormal state
20 times no abnormal state
20 times no abnormal state
Occurrence of fine crack
many fine cracks
many fine cracks --

In column 9, at Table 2, please insert column 4 after column 3 as follows:

-- ① 80Ni-20Cr
② 60 $Al_2O_3$-40$TiO_2$
20 times no abnormal state
20 times no abnormal state
20 times no abnormal state
20 times no abnormal state
20 times no abnormal state
20 times no abnormal state
Occurrence of fine crack
many fine cracks
local peel --

Signed and Sealed this

Fourth Day of September, 2007

JON W. DUDAS
*Director of the United States Patent and Trademark Office*